US009360882B2

(12) United States Patent
Kaijala et al.

(10) Patent No.: US 9,360,882 B2
(45) Date of Patent: Jun. 7, 2016

(54) VEHICLE PEDAL WITH INDEX ASSEMBLY FOR CONTACTING SENSOR

(71) Applicants: Murray Kaijala, Elkhart, IN (US); Daniel Wertman, Bristol, IN (US); John R Gietzen, Elkhart, IN (US)

(72) Inventors: Murray Kaijala, Elkhart, IN (US); Daniel Wertman, Bristol, IN (US); John R Gietzen, Elkhart, IN (US)

(73) Assignee: CTS CORPORATION, Elkhart, IN (US)

( * ) Notice: Subject to any disclaimer, the term of this patent is extended or adjusted under 35 U.S.C. 154(b) by 32 days.

(21) Appl. No.: 14/039,434

(22) Filed: Sep. 27, 2013

(65) Prior Publication Data

US 2014/0090512 A1 Apr. 3, 2014

Related U.S. Application Data

(60) Provisional application No. 61/709,045, filed on Oct. 2, 2012, provisional application No. 61/873,684, filed on Sep. 4, 2013.

(51) Int. Cl.
*G05G 1/30* (2008.04)
*G05G 1/38* (2008.04)

(52) U.S. Cl.
CPC ..... *G05G 1/38* (2013.01); *Y10T 74/2054* (2015.01)

(58) Field of Classification Search
CPC ..... G05G 1/30; G05G 1/38; B60K 26/021
See application file for complete search history.

(56) References Cited

U.S. PATENT DOCUMENTS

| | | | | |
|---|---|---|---|---|
| 5,115,186 | A | 5/1992 | Reinartz et al. | |
| 5,133,321 | A | 7/1992 | Hering et al. | |
| 5,416,295 | A | 5/1995 | White et al. | |
| 5,768,946 | A | 6/1998 | Fromer et al. | |
| 5,887,488 | A | 3/1999 | Riggle | |
| 6,089,120 | A | 7/2000 | Lochle et al. | |
| 6,220,222 | B1 | 4/2001 | Kalsi | |
| 6,370,983 | B1 | 4/2002 | Nakamura | |
| 6,408,712 | B1 | 6/2002 | Bolisetty et al. | |
| 6,460,429 | B1 | 10/2002 | Staker | |
| 6,470,768 | B2 * | 10/2002 | Kato et al. | 74/513 |
| 6,474,191 | B1 | 11/2002 | Campbell | |
| 6,531,667 | B2 | 3/2003 | Becker et al. | |
| 6,725,741 | B2 * | 4/2004 | Menzies | 74/514 |
| 7,216,563 | B2 * | 5/2007 | Willemsen et al. | 74/512 |
| 2003/0051571 | A1 | 3/2003 | Staker | |

(Continued)

FOREIGN PATENT DOCUMENTS

| | | | |
|---|---|---|---|
| EP | 1094380 | A2 | 4/2001 |
| EP | 1428715 | A2 | 6/2004 |
| WO | 2006040339 | A1 | 4/2006 |

*Primary Examiner* — Vicky Johnson
(74) *Attorney, Agent, or Firm* — Daniel Deneufbourg

(57) ABSTRACT

A vehicle pedal comprising a housing for a pedal arm with a drum, a rotor coupled to the drum and including a contactor that slides against a strip of resistive material in the housing, and an assembly for setting and locking the index position of the rotor. In one embodiment, the rotor extends through a window that is defined in the housing and limits the movement of the rotor during the index setting operation. In one embodiment, a plastic pin that is either separate from or unitary with the rotor is fitted into a slot defined in the drum. In another embodiment, a potting material is deposited and cured in the slot in the drum for locking the pin in the slot. In another embodiment, the pin is unitary with the drum of the pedal arm and is press-fitted into a slot in the rotor. In a further embodiment, the drum and rotor include respective plates and the pin is a clip that locks the plates together.

7 Claims, 10 Drawing Sheets

(56) References Cited

U.S. PATENT DOCUMENTS

| | | | | |
|---|---|---|---|---|
| 2003/0066375 | A1 | 4/2003 | Menzies | |
| 2003/0070503 | A1 | 4/2003 | Menzies | |
| 2003/0226419 | A1* | 12/2003 | Yokochi et al. | 74/513 |
| 2004/0149070 | A1* | 8/2004 | Solta | 74/513 |
| 2004/0155647 | A1 | 8/2004 | Green et al. | |
| 2005/0267664 | A1 | 12/2005 | Ouyang | |
| 2010/0077886 | A1 | 4/2010 | Seiltz et al. | |
| 2010/0313698 | A1 | 12/2010 | Yoshida et al. | |
| 2010/0313699 | A1 | 12/2010 | Yoshida et al. | |
| 2011/0162481 | A1 | 7/2011 | Campbell | |
| 2015/0128755 | A1* | 5/2015 | Kaijala | 74/514 |

* cited by examiner

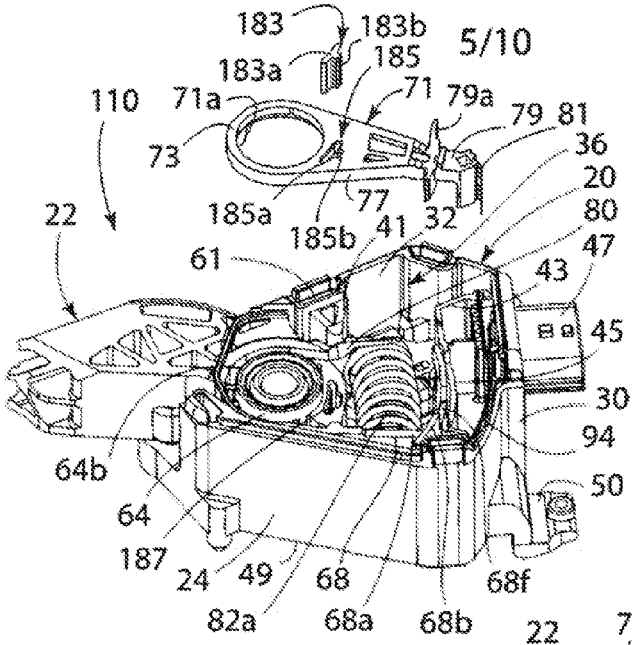
FIGURE 6
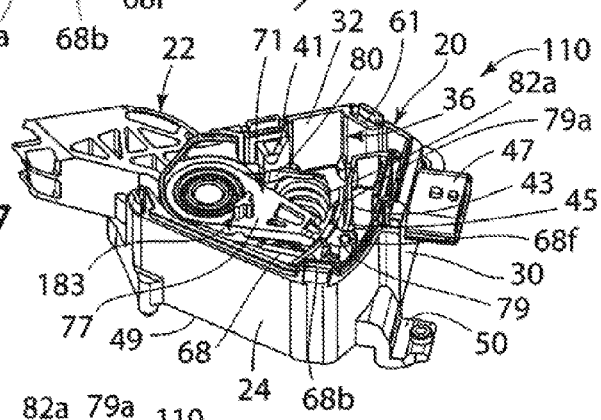
FIGURE 7
FIGURE 8
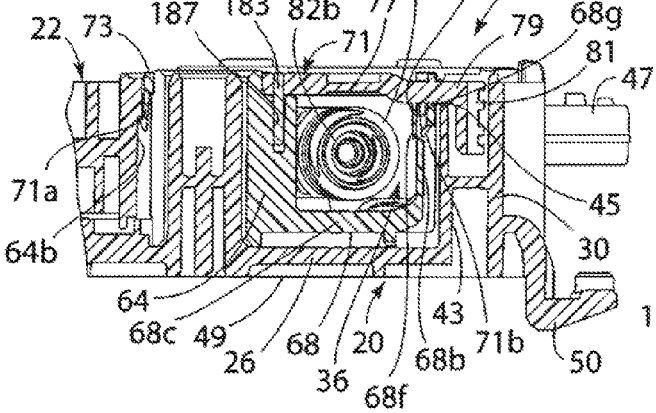
FIGURE 9
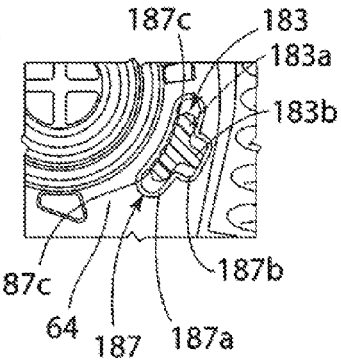

FIGURE 13
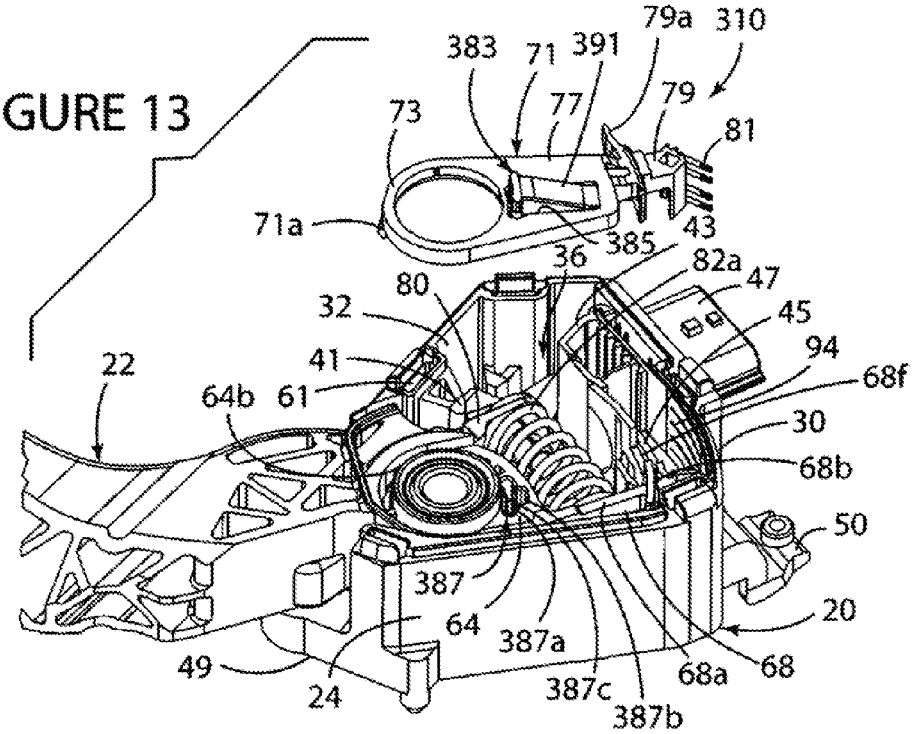
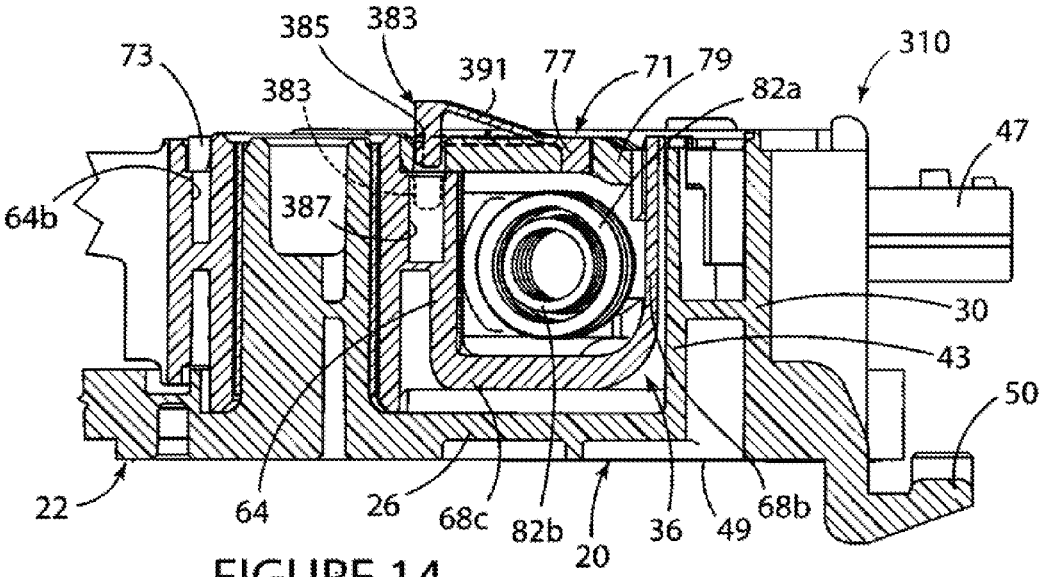
FIGURE 14

FIGURE 15
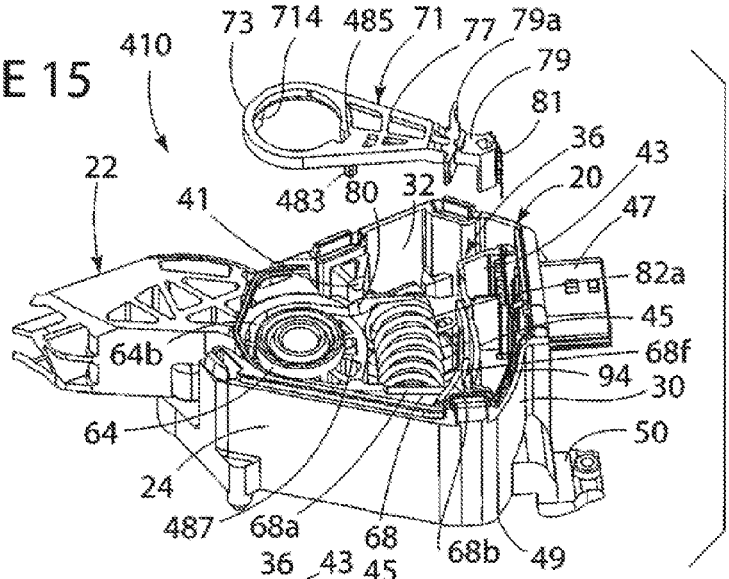
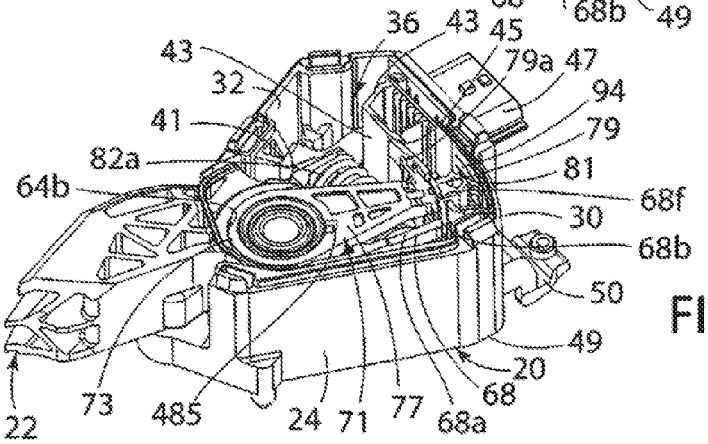
FIGURE 16
FIGURE 17
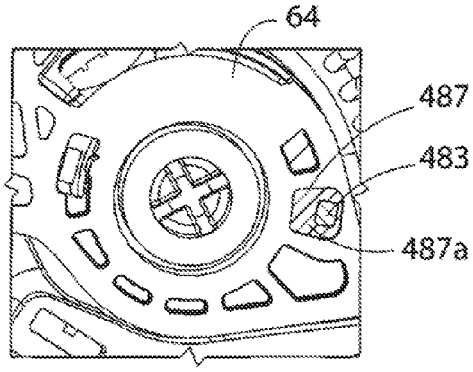

VEHICLE PEDAL WITH INDEX ASSEMBLY FOR CONTACTING SENSOR

CROSS-REFERENCE TO RELATED APPLICATIONS

This application claims the benefit of the filing dates and disclosures of U.S. Provisional Application Ser. No. 61/709,045 filed on Oct. 2, 2012 and U.S. Provisional Application Ser. No. 61/873,684 filed on Sep. 4, 2013, which are explicitly incorporated herein by reference as are all references cited therein.

FIELD OF THE INVENTION

The present invention relates generally to a pedal mechanism, and in particular, to a vehicle pedal with a contacting sensor and an index assembly for the contacting position sensor.

BACKGROUND OF THE INVENTION

Automobile accelerator pedals have, in the past, been linked to engine fuel subsystems by a cable, generally referred to as a Bowden cable. While such accelerator pedal designs varied, the typical return spring and cable friction together created a common and accepted tactile response for automobile drivers. For example, friction between the Bowden cable and its protective sheath reduced the foot pressure required from the driver to hold a given throttle position. Likewise, friction prevented road bumps felt by the driver from immediately affecting throttle position.

The mechanical cable-driven throttle systems, however, have been replaced with a more fully electronic, sensor-driven approach. With the fully electronic approach, the position of the accelerator pedal is read with a position sensor, which has been either of the contacting or non-contacting variety, and a corresponding position signal is made available for throttle control. The sensor-based approach has been especially compatible with electronic control systems in which accelerator pedal position is one of the several variables used for engine control.

Pedals including contacting position sensors have typically incorporated a potentiometer structure in the form of a rotor arm coupled to the pedal arm and adapted for rotation in response to rotation of the pedal arm and further adapted for contacting and sliding movement against the surface of a strip of resistive film located in the interior of the pedal.

The index position of the rotor arm has typically been set and locked with the use of metal pin that extends through the rotor arm and is fastened into the drum of the pedal arm.

The present invention is directed to a new, simple, cost-effective pedal assembly that includes a contacting position sensor, a hysteresis/friction generating assembly and alternatively also a kickdown assembly.

The present invention is also directed to a new assembly for setting and locking the index position of the rotor arm in a pedal with a contacting position sensor.

SUMMARY OF THE INVENTION

The present invention is generally directed to a vehicle pedal comprising a housing for a pedal arm including a drum mounted for rotation in the housing, a rotor in the housing and coupled to the drum for rotation with the drum, the rotor including an arm, a sensor including a strip of resistive material in the housing, the rotor including a contactor on the arm that slides against the strip of resistive material; and an assembly for setting and locking the index position of the rotor in the housing including a window defined in the housing, the arm of the rotor extending through the window for setting the index position of the rotor in the housing, and a pin for locking the index position of the rotor in the housing.

In one embodiment, the drum includes a plate, the window being defined in the plate of the drum and limiting the movement of the rotor during setting of the index position of the rotor.

In one embodiment, the rotor defines a through-hole and the drum of the pedal arm defines a recess, the pin being made of a plastic material and extending through the rotor and fitted in the recess in the drum of the pedal arm.

In one embodiment, the pin is a shear pin unitary with the rotor.

In one embodiment, the pin is unitary with a flexible beam that is unitary with the rotor.

In one embodiment, the pin is unitary with the rotor and is inserted into the recess defined in the drum of the pedal arm and a potting material is inserted and cured in the recess of the drum to lock the pin in the recess and the rotor to the drum.

In one embodiment, the pin is unitary with the drum of the pedal arm and is fitted into a slot defined in the rotor.

In one embodiment, the drum of the pedal arm and the rotor include respective first and second plates, the pin being in the form of a clip that locks the first and second plates together and locks the index position of the rotor on the drum of the pedal arm.

The present invention is also directed to a vehicle pedal comprising a housing for a pedal arm including a drum mounted for rotation in the housing, a rotor in the housing and coupled to the drum for rotation in the housing in response to the rotation of the drum, a sensor including a strip of resistive material in the housing, the rotor including a contactor that slides against the strip of resistive material, and an assembly for locking the index position of the rotor relative to the sensor assembly including a plastic pin that locks the rotor in position on the drum of the pedal arm.

In one embodiment, the pin is inserted through a hole defined in the rotor and fitted into a slot defined in the drum of the pedal arm.

In one embodiment, the slot in the drum defines a plurality of ribs press fitted against the pin.

In one embodiment, the pin is a shear pin unitary with the rotor.

In one embodiment, the pin is unitary with a flexible beam that is unitary with the rotor.

In one embodiment, the pin is unitary with the rotor and is inserted into a well defined in the drum of the pedal arm and a potting material is inserted and cured in the well of the drum to lock the pin in the well and the rotor to the drum.

In one embodiment, the pin is unitary with the drum of the pedal arm and is fitted into a slot defined in the rotor.

In one embodiment, the slot in the rotor includes a plurality of ribs that are press-fitted against the pin.

In one embodiment, the drum includes a first plate and the rotor includes a second plate, the first and second plates abutted against each other and the pin being in the form of a clip that locks the first and second plates together for locking the rotor to the drum of the pedal arm.

Additional benefits and advantages of the present invention will become apparent to those skilled in the art to which the present invention relates from the subsequent description of the embodiments and the appended claims, taken in conjunction with the accompanying drawings.

BRIEF DESCRIPTION OF THE DRAWINGS

In the accompanying drawings that form part of the specification, and in which like numerals are employed to designate like parts throughout the same:

FIG. 6 is a broken, exploded side perspective view of another embodiment of a vehicle pedal assembly in accordance with the present invention without the cover;

FIG. 7 is a broken, side perspective view of the vehicle pedal assembly of FIG. 6 with the sensor rotor and the index pin in their preloaded position on the drum of the pedal arm;

FIG. 8 is a broken, part side elevational, part vertical cross-sectional view of the index pin secured and locked in the slot in the drum of the pedal arm of the vehicle pedal assembly of FIG. 6;

FIG. 9 is a broken, part plan view, part horizontal cross-sectional view of the index pin secured and locked in the slot in the drum of the vehicle pedal assembly of FIG. 6;

FIG. 13 is a broken, exploded, perspective view of another embodiment of a vehicle pedal assembly in accordance with the present invention without the cover;

FIG. 14 is a broken, part side elevational view, part vertical cross-sectional view of the vehicle pedal assembly of FIG. 13 depicting the index pin on the sensor rotor in both its preloading and locking positions in the slot in the drum of the pedal arm;

FIG. 15 is broken, exploded, perspective view of another embodiment of a vehicle pedal assembly in accordance with the present invention without the cover;

FIG. 16 is a broken, side perspective view of the vehicle pedal assembly of FIG. 15 with the sensor rotor secured to the drum pedal arm in the housing;

FIG. 17 is an enlarged broken, part side elevational view, part vertical cross-sectional view of the vehicle pedal assembly of FIG. 15 with the index pin locked in the slot in the drum of the pedal arm;

DETAILED DESCRIPTION OF THE EMBODIMENTS

Figure 1:
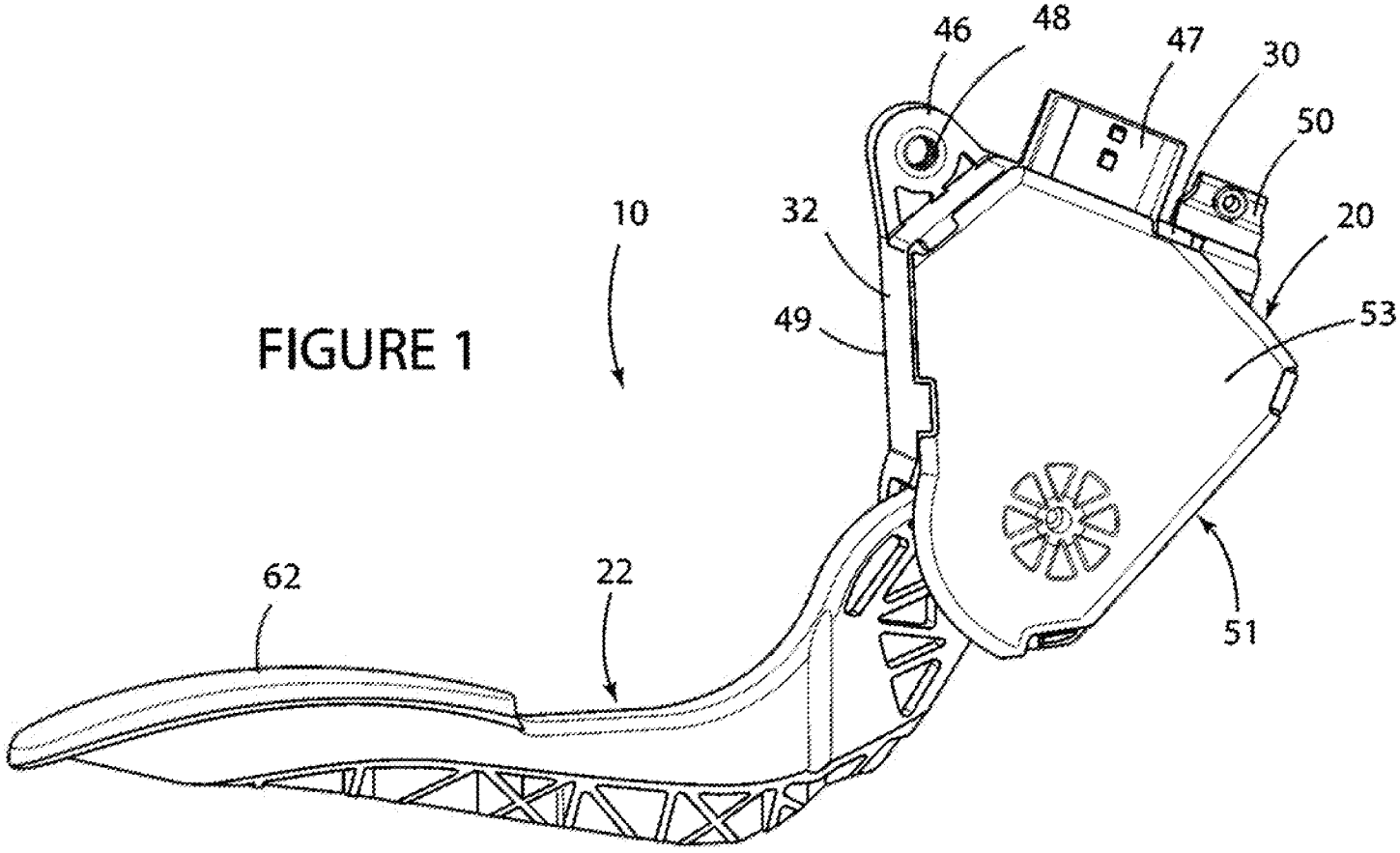
FIG. 1 is a perspective view of a vehicle pedal assembly in accordance with the present invention.

FIGS. 1-5 depict a contacting sensor vehicle pedal assembly 10 in accordance with the present invention which comprises, in part, a pedal housing 20 and a pedal arm 22 extending into the pedal housing 20 and which may both be made of a suitable molded plastic material.

Referring to FIGS. 1-5, the pedal housing 20 includes a base wall or floor 24; a side wall 26 extending generally normally outwardly from the back edge of the floor 24; a back or rear generally arcuate wall 30 extending outwardly from the back or rear peripheral edge of the base wall 24 and the side wall 26; and a top wall 32 extending between the top peripheral edge of the side wall 26 and the top peripheral edge of the back wall 30 in a relationship spaced and opposed to the base wall 24.

Figure 2:
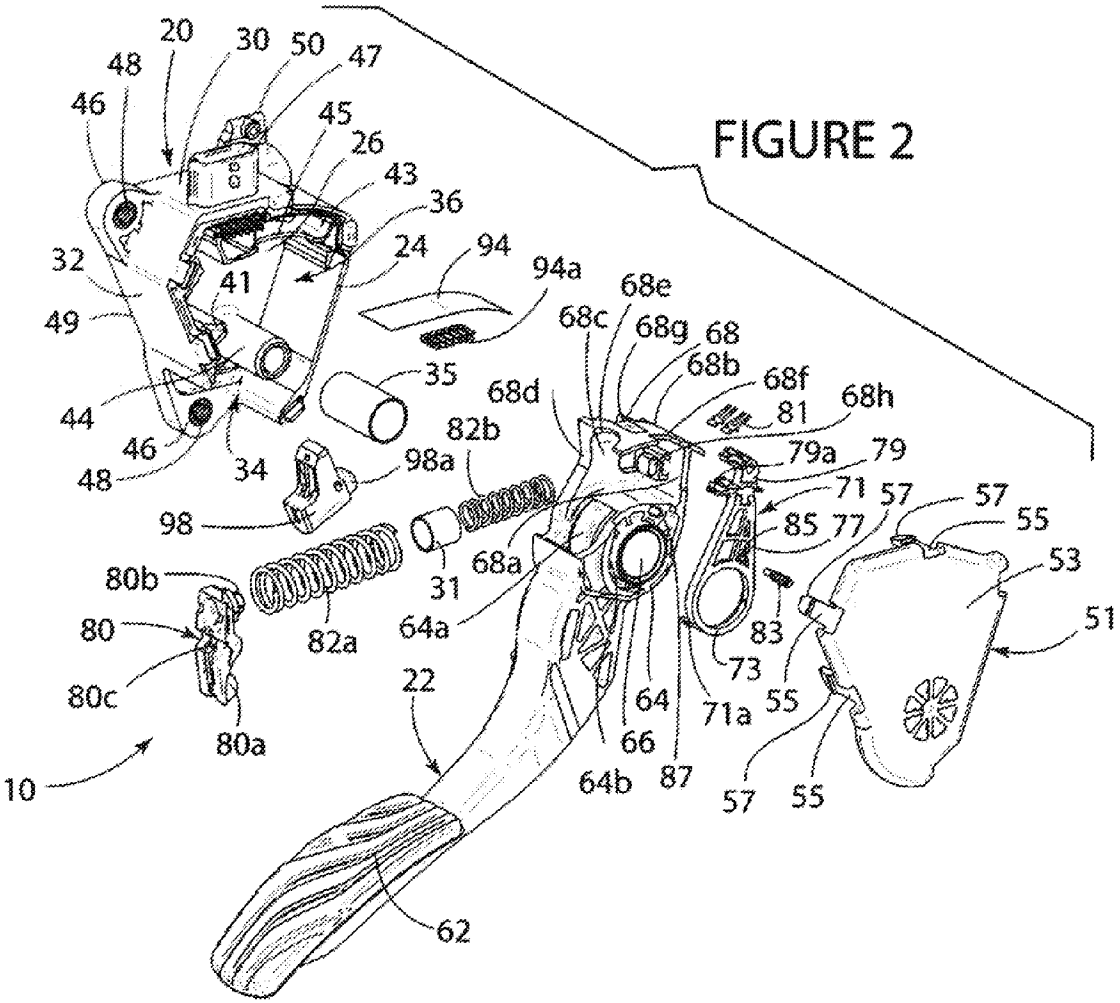
FIG. 2 is an exploded perspective view of the vehicle pedal assembly of FIG. 1.
Figure 3:
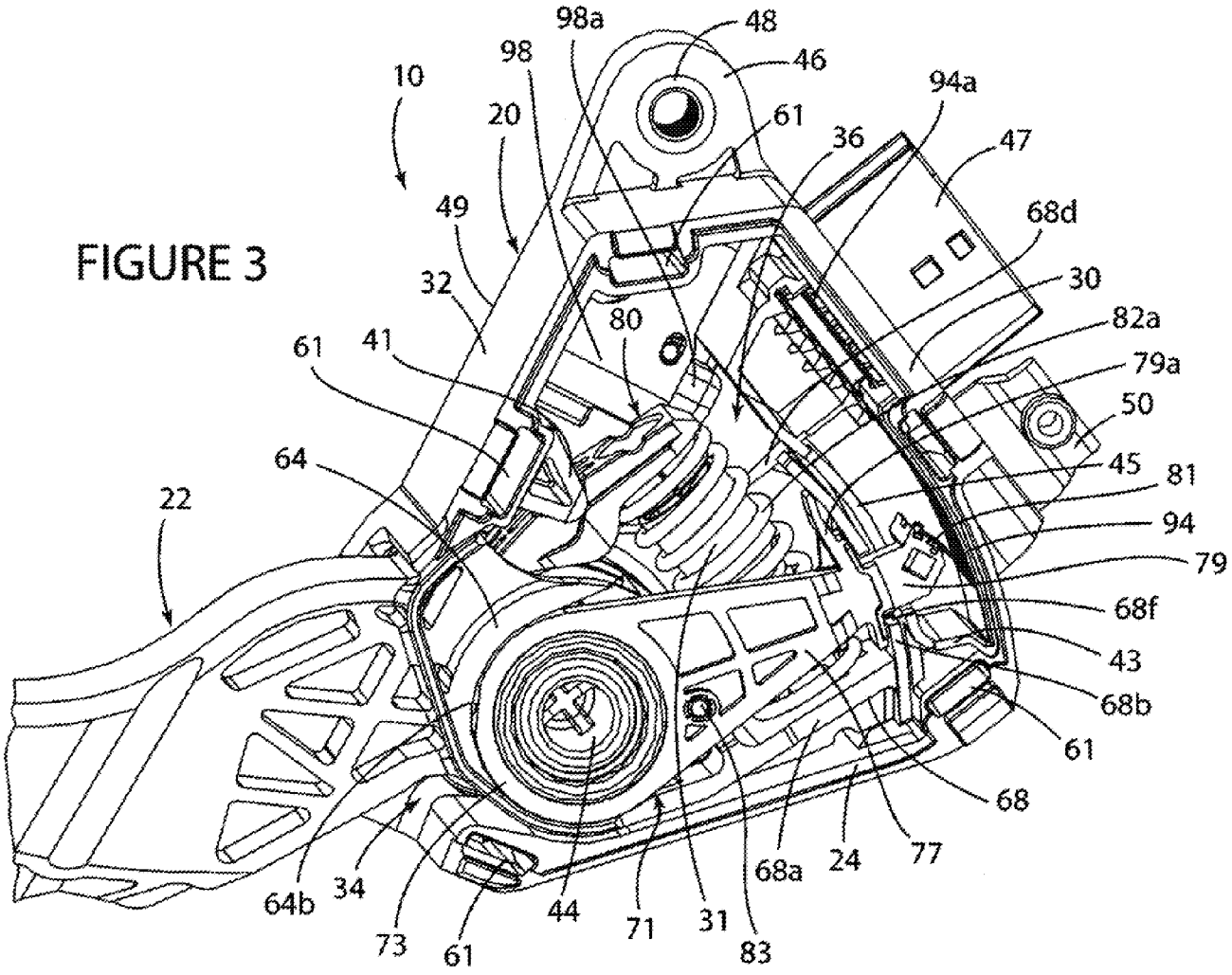
FIG. 3 is a broken, side perspective view of the vehicle pedal assembly of FIG. 1 with the cover removed.
Figure 4:
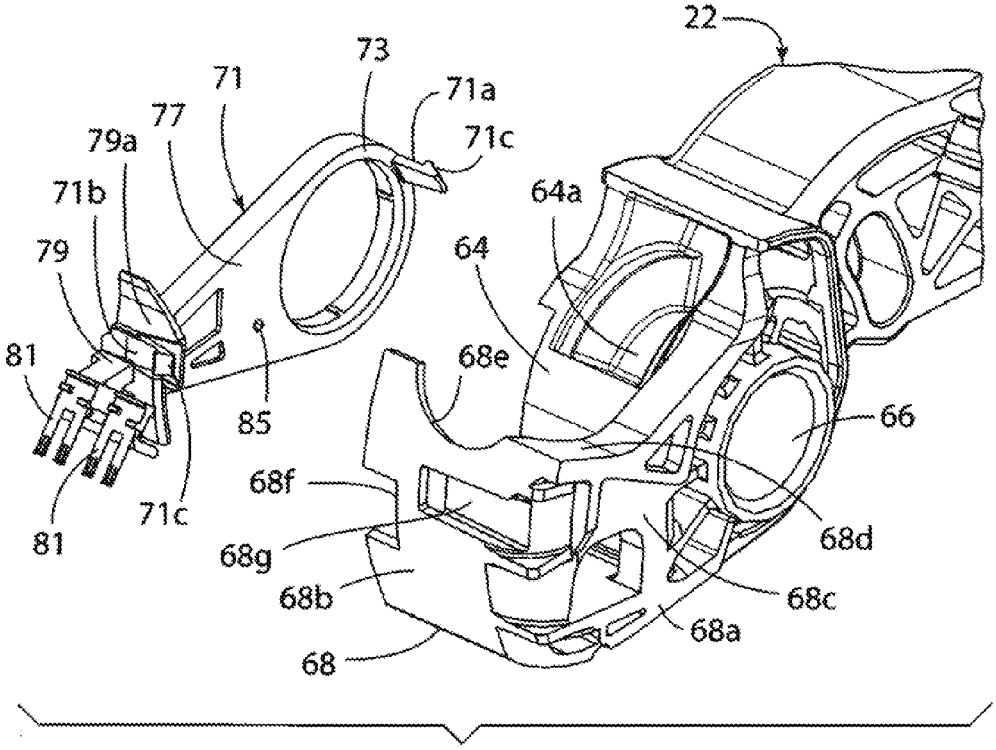
FIG. 4 is a broken, exploded perspective view of the pedal drum and sensor rotor of the vehicle pedal assembly of FIG. 1.

The base wall 24, the side wall 26, the back wall 30, and the top wall 32 together define a front housing opening 34 and an interior housing cavity 36 (FIGS. 2 and 3).

An elongate, hollow, and generally tubular shaft 44 (FIG. 2) projects generally normally unitarily outwardly from the interior surface of the housing side wall 26. The shaft 44 is adapted to receive a cylindrical drum bearing 35 and the drum 64 (FIG. 2) of the pedal arm 22.

As shown in FIGS. 2 and 3, a pivot post 41 extends unitarily outwardly from the interior surface of the top wall 32 of the pedal housing 20 into the interior housing cavity 36.

A sensor assembly wall 43 extends unitarily outwardly from the interior surface of the side wall 26 and into the interior cavity 36 in a relationship spaced from and generally parallel to the back wall 30 of the housing 20. The sensor assembly wall 43 defines a sensor rotor slot 45.

A sensor assembly connector shroud 47 protrudes outwardly from the exterior surface of the back wall 30 of the pedal housing 20. The connector 47 defines a hollow interior for the terminals (not shown) of the sensor assembly.

In the embodiment shown, a pair of spaced-apart anchors or brackets 46 extend and project unitarily outwardly from the pedal housing 20 and, more specifically, extend and project unitarily outwardly from the exterior surface of respective ones of the walls of the housing 20. Each of the anchors 46 defines a generally cylindrically-shaped through aperture that receives an interiorly threaded mounting insert 48.

A pedal mounting clip 50, of the type disclosed in U.S. Pat. No. 8,528,443 for mounting the vehicle pedal assembly 10 to a pedal mounting rack and the disclosure of which is incorporated herein by reference, extends unitarily outwardly from the back wall 30 of the pedal housing 20.

The pedal housing 20 and thus the pedal 10 is securable to a vehicle using fasteners such as bolts or screws (not shown) that extend and are threaded through the mounting insert 48 in the respective anchors 46 and then into respective threaded through-holes (not shown) defined in the firewall (not shown) or the pedal rack (not shown) of the vehicle (not shown) as also disclosed in U.S. Pat. No. 8,528,443.

In the embodiment shown, the housing base wall 24, the housing back or rear wall 30, and the housing top wall 32 are unitary with respective ones of the peripheral edges of the housing side wall 26 to define a base or pedal arm housing member 49. A separate housing cover 51 (FIGS. 1, 2 and 5) is coupled and secured to the base housing member 49 and, more specifically, over and in abutted relationship with the peripheral interior edge of the walls 24, and 32, as described below.

Figure 5:
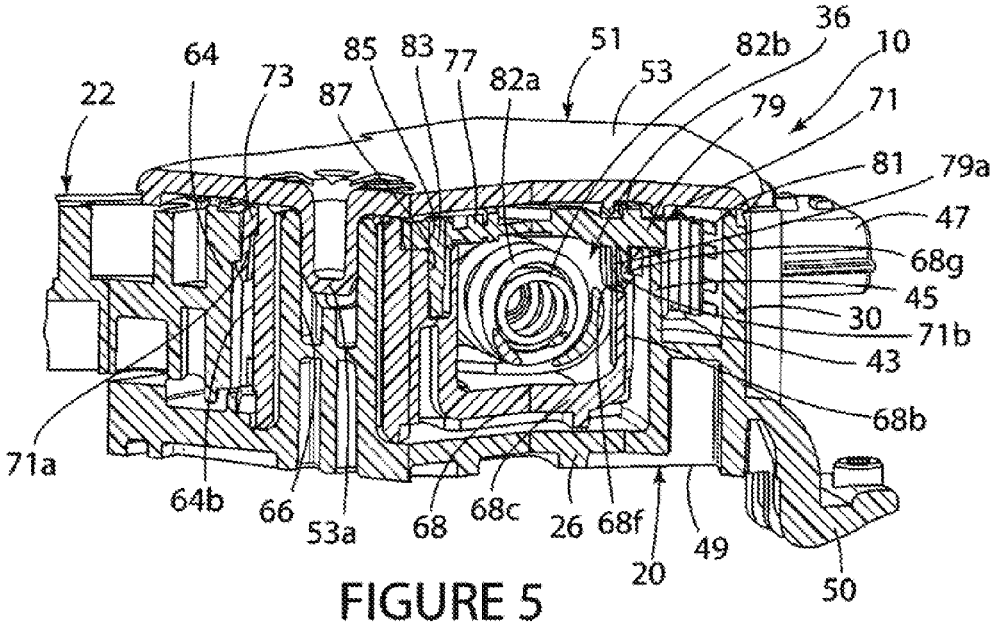
FIG. 5 is a broken, side elevational view of the vehicle pedal assembly of FIG. 1.

Thus, and deferring to FIGS. 1, 2, and 5, the housing cover 51 includes a plate 53 having plurality of elongate and flexible clip arms or prongs 55 extending around the periphery of the plate 53 in a spaced-apart relationship and, more specifically, in a relationship projecting generally normally outwardly from a peripheral edge of the plate 53 of the housing cover 51. Each of the cover clip arms or prongs 55 includes a distal head 57 defining a sloped exterior camming surface and shoulder. The plate 53 additionally includes a generally cylindrical-shaped hollow neck 53*a* projecting outwardly from the interior surface of the plate 53.

Moreover, as shown in FIGS. 2 and 3, respective ones of the housing walls of the base housing member 49 include additional interior partial walls or ribs of plastic material defining respective interior spaced-apart brackets 61 adapted to receive the respective clip arms 55 on the cover 51.

The securement of the housing cover 51 to the housing member 49 includes initially positioning the housing cover 51 and the housing member 49 in a generally parallel relationship opposite each other wherein the respective clip arms 55 on the housing cover 51 are co-linearly aligned with the respective clip receiving brackets 61 in the housing member 49 and then bringing the housing member 49 and cover 51 together into the relationship as shown in FIGS. 1 and 5 wherein the neck 53*a* of the plate 53 is extended into the through hole 66 defined in the drum 64 of the pedal arm 22 and the respective clip arms 55 on the cover 51 are extended into and clipped to the respective brackets 61 in the housing member 49 for securing the housing cover 51 to the housing member 49.

The vehicle pedal assembly 10 also comprises the pedal arm 22 that includes a foot pad 62 (FIG. 1) at a distal first end thereof and the generally cylindrical drum 64 (FIGS. 2, 3, 4, and 5) at a proximal second end thereof.

The drum 64 defines a generally cylindrically-shaped through-hole or aperture 66 (FIGS. 2, 4, and 5) that extends generally centrally through the body and the side walls of the drum 64.

A recessed friction surface 64*a* (FIGS. 2 and 3) is defined and extends into the top of the drum 64. A ring-shaped recess or slot or collar 64*b* (FIGS. 2, 4 and 5) is defined in the side surface of the drum 64 and extends around and spaced from the through-hole or aperture 66. An index pin receiving aperture 87 is also defined in the side of drum 64 (FIGS. 2 and 5).

A platform 68 projects and extends unitarily outwardly from a front face or surface of the drum 64 into the interior cavity 36 and in the structure of the back wall 30 of the housing 20.

As shown in FIGS. 2-5, the platform 68 includes an outwardly extending and generally flat base plate or arm 68*a* that projects outwardly from a lower edge of the front face of the drum 64 into the housing cavity 36 and in the direction of the back wall 30 of the housing 20; a generally arcuate front wall or plate 68*b* extending upwardly from a distal peripheral edge of the base in a plate 68*a* in a relationship spaced from the front of the drum 64 and in the direction of the top wall 32 of the housing 20; and a side wall or plate 68*c* extending between the front of the drum 64 and the back edge of the base plate 68*a* and the front plate 68*b* in a relationship spaced from and generally parallel to the housing side wall 26 and terminating in a kickdown device activation lever arm or plate 68*d* (FIGS. 2 and 3).

The front wall or plate 68*b* includes a top peripheral edge defining a concave recess or slot 68*e*; a side peripheral edge defining a generally rectangular sensor rotor recess or slot or window 68*f*; and an aperture or slot defining a clip receiving bracket 68*g*.

The base plate 68*a*, the front plate 68*b*, and the side plate 68*c* of the platform 68 together define a receptacle or housing unitary with the drum 64 for receiving and supporting a pair of springs 82*a* and 82*b*.

The pedal arm 22 is mounted to the pedal housing 20 in a relationship wherein the drum 64 of the pedal arm 22 extends into the interior cavity 36 of the pedal housing 20 and the shaft 44 in the housing 20 extends through the through-hole 66 in the drum 64 thereby mounting the drum 64 and the pedal arm 22 far rotation relative to the pedal housing 20.

The vehicle pedal assembly 10 further comprises a hysteresis friction assembly that includes an elongate friction lever or pad 80 (FIGS. 1 and 3) and biasing coil springs 82*a* and 82*b*.

The friction lever 80 includes a generally concavely shaped exterior groove or recess 80*c* (FIG. 1) defined and extending into the top surface of the friction lever 80. A grooved friction contact surface 80*a* is defined on and protrudes outwardly from a lower surface of one of ends of the lever 80. A spring guide post 80*b* protrudes outwardly from the lower surface of the opposed end of the lever 80.

As shown in FIG. 3, the friction lever 80 is mounted in the interior housing cavity 36 between the top of the drum 64 and the housing top wall 32 in a relationship wherein the distal end of the pivot post 41 protruding outwardly from the interior surface of the top wall 32 of the housing 20 extends into and is abutted against the top surface 80*c* of the lever 80 and defines a fulcrum or pivot about which the friction lever 80 is adapted to pivot or teeter; the friction contact surface 80*a* on the friction lever 80 is seated and abutted against the contact surface 64*a* on the top of the drum 64; and the spring guide post 81 on the other of the ends of the friction lever 80 receives the top ends of the springs 82*a* and 82*b* and is positioned in a relationship spaced, opposed, and co-linear with the spring guide post 68*h* defined on and protruding outwardly from the interior surface of the base 68*a* of the drum platform 68.

The pair of telescoping coil springs 82*a* and 82*b* are located and mounted in the interior cavity 36 of the housing 20 and more specifically in the receptacle defined by the platform 68 of the drum 64 in a relationship wherein the lower ends of the respective springs 82*a* and 82*b* are mounted and supported in the guide post 68*h* on the base 68*a* of the drum platform 68 and the upper ends of the respective springs 82*a* and 82*b* are mounted and supported against the guide post 80*b* on the lower surface of the one end of the friction lever 80. A hollow plastic tube 31 (FIGS. 2 and 3) is located between the top springs 82*a* and 82*b* to prevent contact between the springs and thus dampen the noise created by the springs during use.

In accordance with the operation of the vehicle pedal assembly 10, the counter-clockwise rotation of the pedal atm 22 causes the counter-clockwise rotation of the drum 64 and the counter-clockwise rotation of the drum platform 68 which causes the springs 82*a* and 82*b* to contract and exert a force against the one end of the friction lever 80 with the guide post 80*b* which, in turn, causes the counterclockwise pivoting of the friction lever 80 about the housing 41 which, in turn, causes the end of the friction lever 80 with the friction surface 80*a* into frictional engagement with the friction surface 64*a* on the drum 64 for generating and transferring a pedal resistance force to the pedal arm 22.

Further details of the use, construction, and function of the hysteresis assembly can be found in U.S. Pat. No. 8,042,430 entitled "Accelerator Pedal for a Vehicle", the contents of which are herein incorporated by reference.

The vehicle pedal assembly 10 still further comprises a contacting potentiometer type position sensor assembly that comprises an elongate strip of Kapton flexible film 94 (FIGS. 2, 3, and 5) and a retention clip 94*a* located in the interior housing cavity 36 and seated against and extending along the interior surface of the back wall 30 of the housing 20 in the region thereof located behind the wall 43; a series of resistor and conductor tracks 94*b* (FIG. 21) on the surface of the film 94; the connector 47 that protrudes outwardly from the exterior surface of the back wall 30 of the housing 20; terminals (not shown) that are insert molded in the connector 47 and extending into the housing 20 and into contact with the tracks on the film 94 and adapted for connection to a vehicle wire harness (not shown) that is connected to the connector 47 which, in turn, is adapted for connection to a vehicle electronic control module (not shown).

Referring to FIGS. 2-5, the position sensor assembly of the pedal assembly 10 further comprises a contacting potentiometer in the form of an adjustable contacting sensor rotor 71 that includes a ring-shaped base 73 that is fitted into the slot 64*b* defined in the side of the drum 64 of the pedal arm 22; an elongate contactor sensor arm 77 that extends from the base 73 into and through the housing cavity 36; a distal end 79 that extends through the slot or window 68*f* defined in the front wall 68*b* of the drum platform 68 and the slot or window 45 defined in the wall 43 of the housing 20; a guide plate or tongue 79*a* protruding generally normally outwardly wall from a side edge of the distal end 79 of the contactor arm 77; and metal contactors 81 adapted to contact and slide against the surface of the film 94 in response to the rotation of the rotor 71.

The rotor 71 also includes a pair of flexible and resilient clip arms or prongs 71*a* and 71*b*. The clip arm 71*a* projects generally normally outwardly from an edge of the ring base 73 and the clip arm 71*b* projects generally normally outwardly from an edge of the distal end 79 of the contactor arm 77 in the same direction as the clip arm 71*a*. Each of the clip arms or prongs 71*a* and 71*b* includes a distal head 71*c* defining an exterior camming surface and shoulder.

The rotor index setting and locking assembly will now be described with reference to FIGS. 2-5.

Initially, the rotor 71 is inserted into the housing 20 and dipped to the drum 64 of the pedal arm 22 into the relationship as described above with the clip 71*a* on the rotor 71 extending into and clipped to and in the slot 64*b* in the drum 64 and the clip 71*b* extending into and clipped to and in the slot 68*g* defined in the plate 68*b* of the drum platform 68.

Thereafter, the output index position of the rotor 71 is adjusted by rotating the rotor 71 +/− two (2) degrees on the drum 64. Once the output position has been selected and set, the rotor 71 is locked in position on the drum 64 with a metal pin or screw 83 that extends through a through aperture or hole 85 defined in the arm 77 of the rotor 71 and then into the generally oval shaped aperture or recess or slot 87 that is defined in the side of the drum 64.

The length of the slot or window 68*f* in the plate 68*b* of the drum platform 68 and the length of the slot 87 in the drum 64 limit the idle output index adjustment and movement of the rotor 71 during the index setting operation to a maximum of +/− two (2) degrees.

Thus, and as described in more detail in for example U.S. Pat. No. 6,474,191, the disclosure of which is also incorporated herein by reference, during operation, the rotation of the pedal arm 22 causes the rotation of the drum 64 which cause the rotation of the sensor rotor 71 which causes the contactors 81 at the distal end 79 of the rotor 71 to brush against the resistor and conductor tracks 94*b* on the film 94. As the contactors 81 move, a voltage applied to the terminals (not shown) of the sensor assembly will change magnitude. This is called an electrical output signal and is indicative of the pedal position.

As shown in FIG. 3, the tongue or plate 79*a* at the distal end 79 of the rotor 71 is abutted and adapted to slide against the interior surface of the plate 68*b* of the drum platform 68 when the rotor 71 is rotated relative to the drum 64 and the drum platform 68 during the index setting operation.

As shown in FIGS. 2 and 3, the vehicle pedal assembly 10 additionally comprises a pedal kickdown assembly 98 of the type disclosed in U.S. Pat. No. 6,418,813, the disclosure of which is also incorporated herein by reference.

The pedal kickdown assembly 98, which includes an outwardly protruding and depressible plunger 98*a* is inserted and fitted into the interior cavity 36 of the housing 20 in a relationship wherein the plunger 98*a* is located opposite and facing the lever arm 68*d* on the drum platform 68.

In the embodiment shown, the kickdown assembly 98 is located in the cavity 36 between the drum 64 and the housing back wall 30 in an upper corner wherein the back wall 30 meets the top wall 32 and the side wall 26.

Although not described herein in any detail, it is understood that when the pedal arm 22 is rotated, the lever arm 68*d* on the drum platform 68 will rotate counter-clockwise into abutting relationship with the plunger 98*a* of the kickdown assembly 98 to depress the plunger 98 and activate the kickdown assembly 98 and generate an opposing mechanical resistance tome on the pedal arm 22 adapted to provide tactile kickdown feedback to the foot of the operator.

FIGS. 6-9 depict another embodiment of a pedal assembly 110 in accordance with the present invention which includes the same elements as the pedal assembly 10 and the same numbers have been used in FIGS. 6-9 to designate such elements and the earlier description of the structure and function of such elements is incorporated herein by reference with respect to the pedal assembly 110, except as otherwise discussed in more detail below.

Specifically, the index setting and locking assembly of the pedal assembly 110 differs from the pedal assembly 10 in that the pedal assembly 110 includes an oval-shaped index pin 183 made of a suitable non-metallic material including, for example, a suitable plastic material such as a PP extruded material and which is adapted to be inserted first through an oval shaped through-hole 185 defined in the arm 77 of the contactor rotor 71 and then into an oval-shaped aperture or slot or recess 187 defined in the side of the drum 64 of the pedal arm 22.

The pin 183 includes a generally oval-shaped and curved body 183*a* and a head or tab 183*b* protruding generally centrally outwardly and unitarily from the outer surface of the body 183*a*. The through-hole 185 defined in the arm 77 of the rotor 71 defines a first generally oval-shaped and curved base through-hole 185*a* corresponding in shape and size to the body 183*a* of the pin 183 and a second smaller through-hole 185*b* that opens into the first through-hole 185*a* and corresponds in shape and size to the head 183*b* of the pin 183. The slot 187 defined in the drum 64 of the pedal arm 22 includes a first generally oval-shaped and curved base slot 187*a* that has the same width as, but is longer than, the body 183*a* of the pin 183 and a second smaller slot 187*b* that has the same width as, but is longer than, the head 183*b* of the pin 183

The interior surface of the drum 64 defining the slot 187*a* includes a plurality of elongate, outwardly protruding, and spaced-apart teeth or ridges or ribs 187*c* (FIG. 9).

The index assembly of the pedal assembly 110 allows for the setting and locking of the idle output position of the rotor 71 as described in more detail below.

Initially, the rotor 71 is fitted in the cavity 36 of the housing 20 and onto the drum 64 of the pedal arm 22 into the position as shown in FIG. 7 wherein the base 73 of the rotor 71 is fitted in the ring slot 64*b* in the side of the drum 64 and the arm 77 of the rotor 71 extends through the cavity 36 of the housing 20 and the distal end 79 thereof extends through the slot or window 631 in the plate 68*b* of the drum platform 68 and the slot or window 45 in the wall 43 of the housing 20, respectively.

Then, the index pin 183 is preloaded (i.e., inserted) into the through-hole 185 in the arm 77 of the rotor 71. Thereafter, the index output position of the rotor 71 is set by rotating the rotor 71 +/− two (2) degrees to the desired index output position with the contactors 81 at the distal end 79 of the rotor 71 against the surface of the resistive film 94. Once the idle output position has been set, the pin 183 is pushed or pressed axially downwardly through the through-hole 185 in the rotor 71 and into the slot 187 defined in the side of the drum 64 into a relationship wherein the outer surface of the body 183*a* of the pin 183 is abutted and press-fitted against the plurality of ribs 187*c* in the slot 187 of the drum 64 to secure and lock the pin 183 in the drum 64 which in turn secures and locks the rotor 71 to the drum 64 which in turn secures and locks the index position of the rotor 71.

The length of the slot or recess 68*f* in the plate 68*b* of the drum platform 68 in combination with the length of the slot 187 in the drum 64 limit the idle output adjustment and movement of the rotor 71 during the setting operation to a maximum of +/− two (2) degrees.

Figures 10, 11, 12:
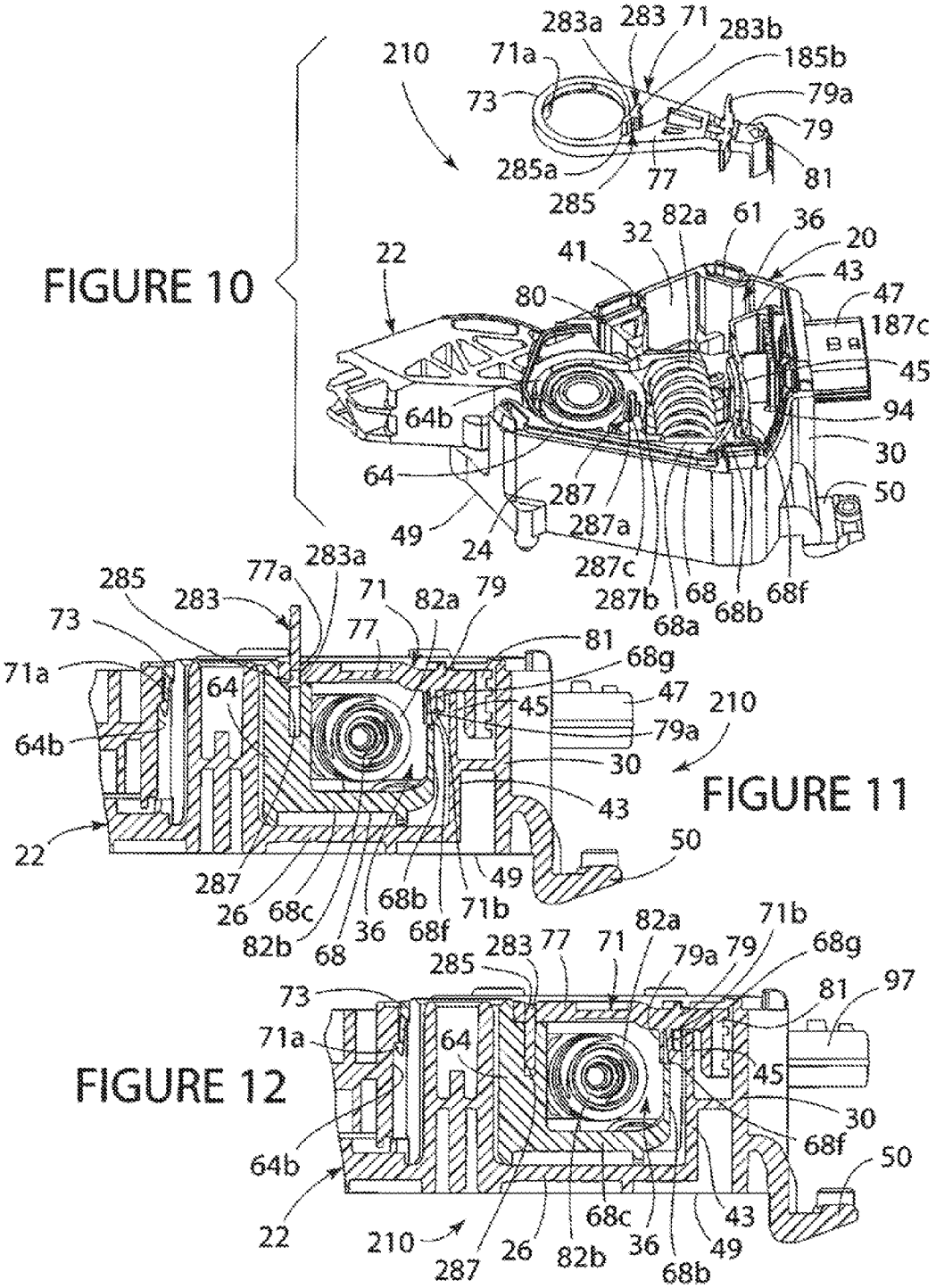
FIG. 10 is a broken, exploded perspective view of another embodiment of a vehicle pedal assembly in accordance with the present invention without the cover.
FIG. 11 is a broken, part side elevational view, part vertical cross-sectional view of the vehicle pedal assembly of FIG. 10 with the rotor in its preloaded position on the drum of the pedal arm.
FIG. 12 is a broken part side elevational view, part vertical cross-sectional view of the vehicle pedal assembly of FIG. 10 with the sensor rotor with the index pin secured and locked in the slot in the drum of the pedal arm.

FIGS. 10-12 depict another embodiment of a pedal assembly 210 in accordance with the present invention which includes the same elements as the pedal assembly 10 and thus the same numbers have been used in FIGS. 10-12 to designate such elements and the earlier description of the structure and function of such elements is incorporated herein by reference with respect to the pedal assembly 210 except as otherwise discussed in more detail below.

In the pedal assembly embodiment 210, the index setting and locking assembly comprises the combination of an index pin 283; a through-hole 285 in the rotor 71; and a slot 287 in the side of the drum 64, all identical in shape structure and material to the index pin 183, through-hole 185, and the slot 187, respectively, of the index assembly of the pedal assembly 110 and of the structure and function thus the earlier description is of such elements incorporated herein by reference.

In this embodiment as shown in FIG. 11, however, the pin 283 is a shear type pin that is unitary and integral with and molded as part of the arm 77 of the rotor 71 and is connected to the material of the arm 77 of the rotor 71 by a thin section or region of plastic material 77*a* extending between the arm 77 of the rotor 71 and the outer surface of the pin 283.

The index assembly in accordance with this embodiment allows for the setting and locking of the idle output position of the rotor 71 as follows. Initially, and as described earlier with respect to the other pedal assembly embodiments; and incorporate herein by reference, the rotor 71 is fitted in the cavity 36 of the housing 20 and to the drum 64 of the pedal arm 22 into the position as shown in FIG. 11 wherein the base 73 of the rotor 71 is fitted in the slot 64*b* in the side of the drum 64; the arm 77 extends through the cavity 36 in the housing 20; the distal end 79 thereof extends through the slots or windows 68*f* and 43 in the plate 68*b* of the drum platform 68 and the wall 43, respectively; and the contactors 81 are placed in contact against the film 94.

Then, the index output position of the rotor 71 is adjusted and set by rotating the rotor 171 +/− two (2) degrees to the desired index output position. Once the idle output position has been set, the pin 283 is pushed or pressed axially downwardly to shear or tear the pin 283 away from the material 77*a* coupling the same to the rotor 71 and then the pin 283 is pushed or pressed further axially downwardly through the through-hole 285 in the rotor 71 and into the slot 287 defined in the drum 64 in the same manner as described earlier with respect to the pin 183 into the relationship as shown in FIG. 12 wherein the outer surface of the pin 283 is abutted and press-fitted against plurality of ribs 287*c* in the slot 287 for securing the pin 23 in the drum 64 which secures the rotor 71 to the drum 64 and secures and locks the index position of the rotor 71.

The length of the slot or recess 68*f* in the plate 68*b* of the drum platform 68 and the length of the slot 287 in the drum 64 limit the idle output adjustment and movement of the rotor 71 during the index setting operation to a maximum of +/− two (2) degrees.

FIGS. 13 and 14 depict another embodiment of pedal assembly 310 in accordance with the present invention which includes several of the same elements as the pedal assembly 10 and thus the same numbers have been used in FIGS. 13 and 14 to designate the same elements and the earlier description if the structure and function of such elements is incorporated herein by reference with respect to the pedal assembly 310 except as otherwise discussed in more detail below.

The index setting and locking assembly in accordance with this pedal assembly embodiment 310 comprises the combination of an oval shaped index pin 383 made of a suitable non-metallic or plastic material as described earlier and press-fitted into an oval shaped aperture or slot 387 that is defined in the drum 64 of the pedal arm 22.

The pin 383 and the slot 387 are identical to the pin 183 and the slot 187 of the pedal assembly 110 and thus the earlier description thereof is incorporated herein by reference.

In this embodiment however, the pin 383 is integral and unitary with the distal end of an elongate and flexible beam 391 that has been cut out of the material of the arm 77 of the rotor 71 and includes a proximal end integral and unitary with and projecting outwardly from the outer surface of the arm 77 of the rotor 71. The beam 391 defines a cut-out 385 in the arm 77 of the rotor 71.

The index assembly of this pedal assembly embodiment allows for the setting and locking of the idle output position of the rotor 71 as described below.

Initially, the rotor 71 is fitted in the cavity 36 of the housing 20 and onto the drum 64 of the pedal arm 22 in the same manner as described earlier with respect to the other pedal assemblies and thus incorporated herein by reference into the position as shown in FIG. 14 wherein the base 73 of the rotor 71 is fitted and clipped into the slot 64*b* in the side of the drum 64; the arm 77 extends through the cavity 36 in the housing 20; the distal end 79 extends through the slots or windows 68*f* and 45 in the plate 68*b* of the drum platform 68 and the wall 43 in the housing 20, respectively; and the contactors 81 are placed in contact with the film 94.

Then, the index output position of the rotor 71 is set by rotating the rotor 71 +/− two (2) degrees to the desired index output position with the contactors 81 abutted against the film 94. Once the idle output position has been set, the pin 383 is pushed or pressed axially downwardly through the cut-out 385 in the arm 77 of the rotor 71 and into the slot 387 in the drum 64 into a relationship wherein the outer surface of the pin 383 is abutted and press-fitted against the plurality of ribs 387*c* in the slot 387 of the drum 64 for securing and locking the pin 383 in the drum 64 which secures and locks the rotor 71 to the drum 364 and secures and locks the index position of the rotor 71.

The length of the slot or window 68*f* in the wall 68*b* of the drum platform 68 and the length of the slot 387 in the drum 64 limit the idle output adjustment and movement of the rotor 71 during the index setting operation to a maximum of +/− two (2) degrees.

FIGS. 15-17 depict another embodiment of a pedal assembly 410 in accordance with the present invention which includes several of the same elements as the pedal assembly 10 and thus the same numbers have been used in FIGS. 15-17 to designate the same elements and thus the earlier description is incorporated herein by reference with respect to the pedal assembly 410 except as otherwise discussed in more detail below.

In accordance with this pedal assembly embodiment 410, the index assembly comprises the combination of an index tab or pin or finger 483 made of the same material as the pin 183 that is unitary with and integral with and projects outwardly from the lower surface of the base 73 of the rotor 71; a slot 485 defined in the base 73 of the rotor 71 and located therein in a relationship fore and generally vertically co-planar with the index tab 483; and an aperture or slot or well 487 defined in the side of the drum 64 of the pedal arm 22.

According to this embodiment, the through aperture 485 in the base 73 of the rotor 71 and the well or recess or slot 487 in the drum 64 of the pedal arm 22 are of the same shape and size, while the well 487 in the drum 64 has a width greater than the width of the index tab 483.

According to this embodiment, the index assembly allows for the setting of the idle output position of the rotor 71 as described below. Initially, and as described earlier with respect to the pedal assemblies and thus incorporated herein by reference, the rotor 71 is fitted in the cavity 36 of the housing 20 and onto the drum 64 of the pedal arm 22 into the position as shown in FIG. 16 wherein the base 73 of the rotor 71 is fitted in the slot 64*b* in the side of the drum 64; the arm 77 extends through the cavity in the housing 20; the distal end 79 extends through the slots or windows 68*f* and 45 in the plate 68*b* of the drum platform arm 68 and the wall 43, respectively; the contactors 81 are placed in contact with the film 94; and as shown in FIG. 16, the index tab 483 on the base 73 of the rotor 71 is located and extended into the well 487 in the drum 64.

Thereafter, the index output position of the rotor 71 is set by rotating the rotor 71 +/− two (2) degrees to the desired index output position with the contactors 81 in contact with the film 94. Once the idle output position has been set, a potting material 487*a* (FIG. 17) is injected through the slot 485 in the rotor 71 and into the well 487 and subsequently cured to lock the index tab 483 in the drum 64 thus locking the rotor 71 to the drum 64 and thus locking the index position of the rotor 71.

The length of the slot or window 68*f* in the wall 68*b* of the drum platform 68 and the width of the well 487 in the drum 64 limit the idle output adjustment and movement of the rotor 71 during the setting operation to a maximum of +/− two (2) degrees.

Figure 18:
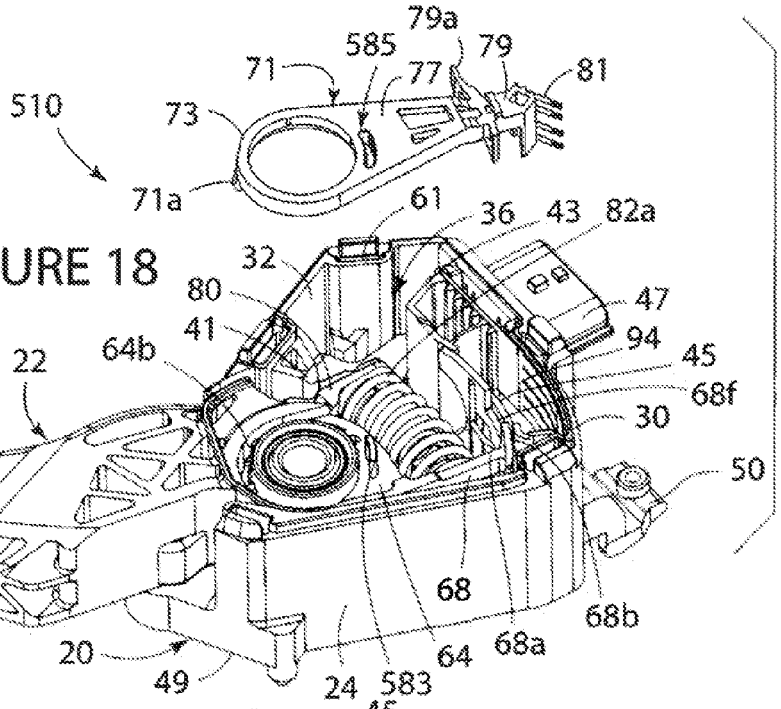
FIG. 18 is a broken, exploded, perspective view of another embodiment of a vehicle pedal assembly in accordance with the present invention without the cover.
Figure 19:
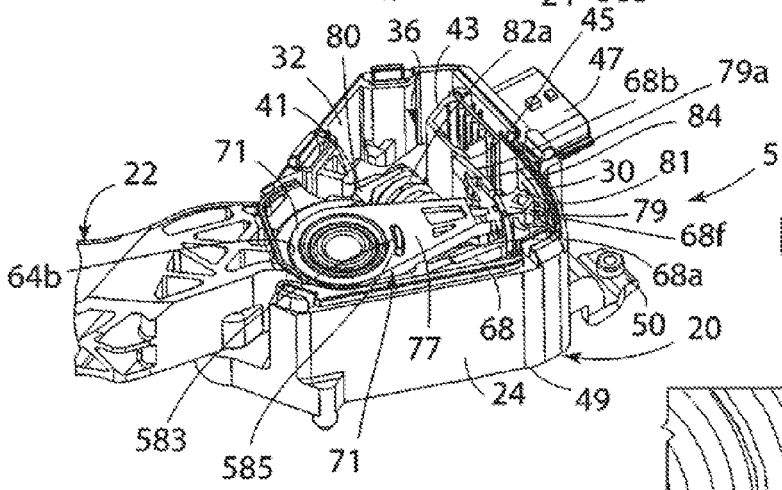
FIG. 19 is a broken, side perspective view of the vehicle pedal assembly of FIG. 16 with the sensor rotor locked on the drum of the pedal arm.
Figure 20:
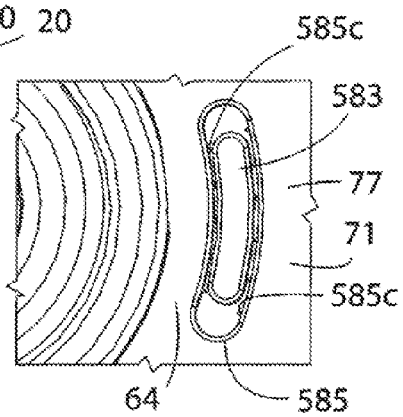
FIG. 20 is an enlarged, broken, side elevational view of the index pin extending through the slot in the sensor rotor of the vehicle pedal assembly of FIG. 18.

FIGS. 18-20 depict yet another embodiment of a pedal assembly 510 in accordance with the present invention which includes the same elements as the pedal assembly 10 and thus the same numbers have been used in FIGS. 18-20 to designate the same elements and the earner description of the structure and function of such elements is incorporated herein by reference with respect to the pedal assembly 510 except as otherwise discussed in more detail below.

In accordance with this embodiment, the index assembly comprises the combination of a generally oval-shaped and curved index heat stake pin or post or tab 583 made of any suitable non-metallic or other material including plastic capable of being heat staked that is unitary with and integral with and projects outwardly from the outer surface of the side of drum 64 of the pedal arm 22; and a generally oval-shaped and curved through-hole 585 that is defined in the arm 77 of the rotor 71.

The tab 583 and through hole 585 are of the same shape but the through hole 585 is longer than the tab 583.

The interior surface of the rotor 71 that defines the through-hole 585 includes a plurality projecting outwardly through elongate and spaced apart teeth or ridges or ribs 585*c*.

The index assembly of this embodiment allows for the setting and locking of the idle output position of the rotor 71 as follows.

Initially, and as described earlier with respect to the other pedal assemblies and thus incorporated herein by reference, the rotor 71 is seated in the interior cavity 36 of the housing 20 and onto the drum 64 of the pedal arm 22 into the relationship as shown with the index heat post 583 on the drum 64 located in and extending into and through the through-hole 585 in the rotor 71.

Thereafter, the index output position of the rotor 71 is set by rotating the rotor 71 +/− two (2) degrees to the desired index output position with the contactors 81 abutted against the film 94. Once the idle output position has been set, the post 583 is heated which causes the material of the post 583 to melt and flow into the space or gap between the outer surface of the post 583 and the interior surface defining the rotor through-hole 585 and still more specifically into the gaps or spaces defined between the ribs 585*c* to secure and lock the post 583 in place in the interior of the through-hole 585 thus securing and locking the index position of the rotor 71.

The length of the slot or window 68*f* in the wall 68*b* of the drum platform 68 and the width of the through-hole 585 in the arm 77 of the rotor 71 limit the idle output adjustment and movement of the rotor 71 during the index setting operation to a maximum of +/− two (2) degrees.

Figure 21:
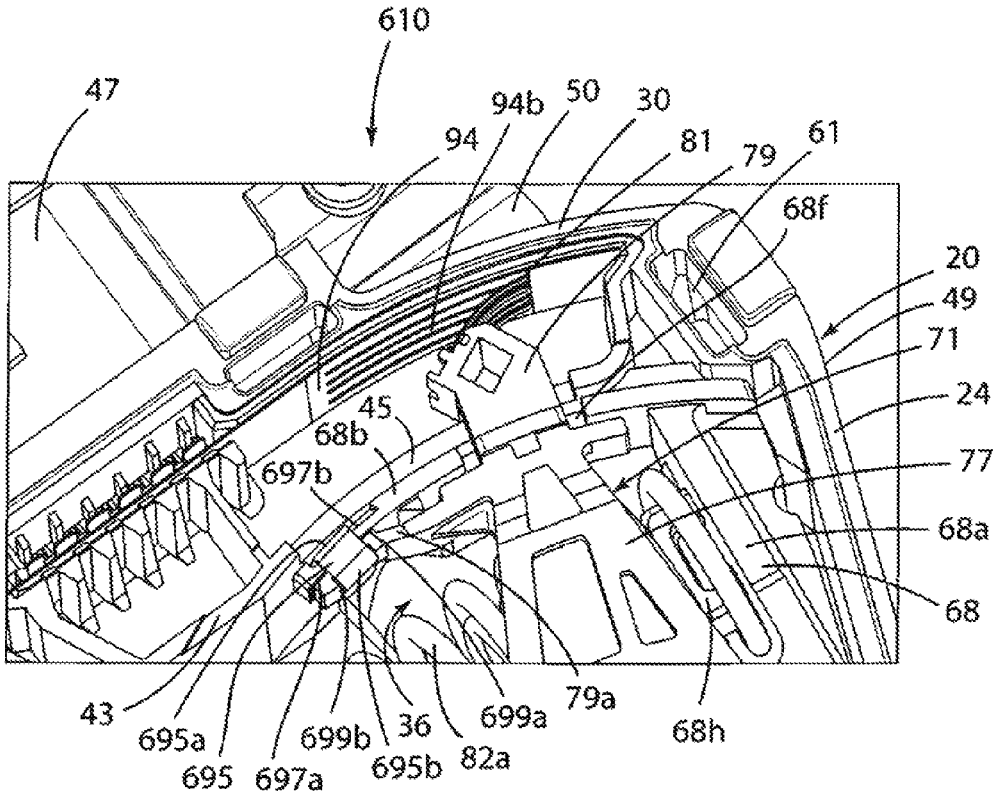
FIG. 21 is an enlarged broken, perspective view of another embodiment of a vehicle pedal assembly in accordance with the present invention without the cover.

FIG. 21 depicts yet another embodiment of a pedal assembly 610 in accordance with the present invention which includes the same elements as the pedal assembly 10 and thus the same numbers have been used in FIG. 21 to designate the same elements and the earlier description is incorporated herein by reference with respect to the pedal assembly 610 except as otherwise discussed in more detail below In accordance with this embodiment, the index assembly comprises the plates 68*b* and the tongue 79*a* on the rotor 71 and the drum 64 respectively in combination with a pin in the form of a metal clip 695 that locks the tongue 79*a* to the plate 68*b*.

As shown in FIG. 21, the interior surface of the plate 68*b* of the drum platform 68 includes a plurality of serrations or teeth 697 adapted to mesh with a corresponding plurality of serrations or teeth 699 on the exterior surface of the tongue 79*a* of the rotor 71; a groove 697*a* is defined in the portion of the exterior surface of the plate 68*b* at a location opposed to the teeth 697; and a groove 699*a* is defined in the portion of the interior surface of the tongue 79*a* located opposite the teeth 699.

The index assembly of this embodiment allows for the setting and locking of the idle output position of the rotor 71 as follows: Initially, the rotor 71 is fitted on the drum 64 of the pedal arm 22 into the relationship as described earlier with respect to the earlier pedal embodiments and thus incorporated herein by reference and as further shown in FIG. 21 wherein the rotor arm 77 extends through the cavity 36 in the housing 20; the distal end 79 extends through the slots or windows 68*f* and 45 in the plate 68*b* of the drum platform 68 and the wall 43 respectively; and the contactors 81 are in contact with the film 94.

Thereafter, the index output position of the rotor 71 is set by rotating the rotor 71 +/− two (2) degrees to the desired index output position. Once the idle output position has been set, the clip 695 is lowered over the top of the plate 68*b* and the tongue 79*a* into the relationship as shown in FIG. 21, wherein the opposed arms 695*a* and 695*b* of the clip 695 exert a compressive farce against the plate 68*b* and the tongue 79*a* which causes the respective serrations or teeth 699 and 697 to lock against each other which locks the tongue 79*a* to the plate 68*f* which in turn locks the rotor 71 on the drum 64 which in turn locks the index position of the rotor 71.

The length of the slot or window 69*f* in the wall 69*b* of the drum platform 68 limits the idle output adjustment and movement of the rotor 71 during the index setting operation to a maximum of +/− two (2) degrees.

Numerous variations and modifications of the vehicle pedal and index assemblies described above may be effected without departing from the spirit and scope of the novel features of the invention. It is thus understood that no limitations with respect to structure of the vehicle pedal assemblies and/or index assemblies illustrated herein are intended or should be inferred. It is, of course, intended to cover by the appended claims all such modifications as fall within the scope of the claims.

We claim:

1. A vehicle pedal comprising:

a housing for a pedal arm including a drum mounted for rotation in the housing, the drum defining a recess;

a rotor in the housing and coupled to the drum for rotation with the drum, the rotor including an arm and defining a through-hole;

a sensor including a strip of resistive material in the housing, the rotor including a contactor on the arm that slides against the strip of resistive material; and an assembly for setting and locking the index position of the rotor in the housing including a window defined in the housing, the arm of the rotor extending through the window for setting the index position of the rotor in the housing, and a pin for locking the index position of the rotor in the housing, the pin extending through the through-hole defined in the rotor and fitted in the recess in the drum of the pedal arm.

2. The vehicle pedal of claim 1 wherein the drum includes a plate, the window defined in the housing being defined in the plate of the drum and limiting the movement of the rotor during setting of the index position of the rotor.

3. A vehicle pedal comprising:

a housing for a pedal arm including a drum mounted for rotation in the housing;

a rotor in the housing and coupled to the drum for rotation with the drum, the rotor including an arm;

a sensor including a strip of resistive material in the housing, the rotor including a contactor on the arm that slides against the strip of resistive material; and an assembly for setting and locking the index position of the rotor in the housing including a window defined in the housing, the arm of the rotor extending through the window for setting the index position of the rotor in the housing, and a pin for locking the index position of the rotor in the housing, the rotor defining a through-hole and the drum of the pedal arm defining a recess, the pin being made of a plastic material and extending through the rotor and fitted in the recess in the drum of the pedal arm.

4. The vehicle pedal of claims 1 or 3 wherein the pin is a shear pin unitary with the rotor.

5. A vehicle pedal comprising:

a housing for a pedal arm including a drum mounted for rotation in the housing;

a rotor in the housing and coupled to the drum for rotation in the housing in response to the rotation of the drum;

a sensor including a strip of resistive material in the housing, the rotor including a contactor that slides against the strip of resistive material; and an assembly for locking the index position of the rotor relative to the sensor assembly including a plastic pin that locks the rotor in position on the drum of the pedal arm, the pin being inserted through a hole defined in the rotor and fitted into a slot defined in the drum of the pedal arm.

6. The vehicle pedal of claim 5 wherein the slot in the drum defines a plurality of ribs press-fitted against the pin.

7. The vehicle pedal of claim 5 wherein the pin is a shear pin unitary with the rotor.

* * * * *